United States Patent [19]

Sweany

[11] 4,143,917

[45] Mar. 13, 1979

[54] IN-SITU RETORTING OF OIL SHALE WITH IN-SITU FORMED ARCHES

[75] Inventor: Glenn A. Sweany, Stamford, Conn.

[73] Assignee: Continental Oil Company, Ponca City, Okla.

[21] Appl. No.: 841,184

[22] Filed: Oct. 11, 1977

[51] Int. Cl.[2] ..... E21B 43/24

[52] U.S. Cl. ..... 299/2

[58] Field of Search ..... 299/2, 12, 13, 19; 208/11 LE, 11 R; 166/259

[56] References Cited

U.S. PATENT DOCUMENTS

| | | | |
|---|---|---|---|
| 1,506,920 | 9/1924 | Chambrier | 299/2 |
| 1,661,390 | 3/1928 | Sinclair | 299/2 |
| 2,630,306 | 3/1953 | Evans | 208/11 R X |
| 3,483,115 | 12/1969 | Haddad et al. | 208/11 R |
| 3,848,927 | 11/1974 | Livingston | 299/13 |
| 4,018,280 | 4/1977 | Daviduk | 299/2 |

FOREIGN PATENT DOCUMENTS

| | | | |
|---|---|---|---|
| 610727 | 10/1948 | United Kingdom | 299/2 |

*Primary Examiner*—Ernest R. Purser

*Attorney, Agent, or Firm*—Cortlan R. Schupbach, Jr.

[57] ABSTRACT

Shale oil is recovered from a horizontal oil shale deposit having an exposed vertical surface by:

(a) tunneling a horizontal sloping tunnel under a portion of the deposit, optionally using material removed from the tunnel to form a service terrace, (b) shaping and lining the floor of the tunnel to form a covered sump sloping to the tunnel mouth, (c) explosively rubblizing the roof and walls of the tunnel, and (d) fireflooding the rubblized zone to retort the kerogen which produces shale oil at the tunnel face through the sump.

The fireflood is preferably by wet combustion which can be either forward or reverse combustion. Oxygen containing gas can be injected through a vertical bore from the surface or from the tunnel face. In one embodiment, the fireflood is prevented from channeling across the top of the rubblized zone by leaving segments of the roof to project downward at intervals. The vertical surface of the deposit can be naturally exposed or exposed by a large diameter bore hole or a vertical mine shaft.

1 Claim, 5 Drawing Figures

IN-SITU RETORTING OF OIL SHALE WITH IN-SITU FORMED ARCHES

This invention deals with an improved method for obtaining shale oil and gas from shale oil deposits. More particularly, this invention deals with a method for obtaining shale oil and gas from shale oil deposits by undercutting the shale using a tunnel, shaping and lining the tunnel to provide a impervious surface to the oil produced and a sump for removal of said oil through the debris, explosively rubblizing the shale and fireflooding the tunnel.

As oil and gas reserves in the world have dwindled, interest has turned to the vast untapped reserves of organic carbonaceous deposits which have not been previously exploited because of economic considerations. Over the years extensive development projects have been conducted to devise economic methods of recovering values from such deposits. One method applied to shale oil generally involves the mining of the oil shale, transporting the shale to the surface, crushing and grinding it before passing through a retort to pyrolyze the kerogen and distill and recover the oil and gas content. The oil content is recovered, the remaining shale is discarded, and the recovered oil is refined. This procedure is expensive and has many inherent technical difficulties. For these reasons the procedure is unattractive from an economical point of view.

Recent developments in shale oil processing have turned to in-situ retorting. Several approaches have been proposed. Fracturing techniques using high explosives have been proposed to establish communication between adjacent bore holes drilled into a formation. Another and probably the most economical and efficient approach is described in U.S. Pat. Nos. 3,001,776; 3,434,757; and 3,661,423. These references as well as others teach the driving of a tunnel under the oil shale deposit. The resultant roof support is then removed and the overlying shale allowed to cave. Following the caving, explosives are detonated in the remaining overlying shale to cause more caving to yield a large volume of rubble in a loosely filled cavern area. U.S. Pat. No. 3,951,456 and 3,661,423 both deal with methods of controlling particle size of the rubblized shale and attempt to control gas flow. In particular, the references point out the difficulty of controlling retort gas flow in a horizontal direction. The references realize that the result in economics in these schemes are poor and discourage exploitation of these reserves.

Oil shale is a marlstone with a laminar structure and cleavage planes similar to those in a true shale and which contains an organic solid known as kerogen. Kerogen, which yields shale oil, is nearly insoluble in most conventional organic solvents but can be removed by pyrolysis or destructive distillation. Shale oil itself is largely soluble in most conventional organic solvents.

In the process of the prior art and the present invention, pyrolysis of kerogen yields three carbonaceous end products at destructive distillation temperatures. Initially oil is formed which leaves the mineral as vapor but is condensed at ordinary room temperatures. In addition, lighter hydrocarbon gases are produced, leaving the balance of the carbon in the organic material as a coke-like residue. Each of these products is, of course, a potential source of energy but the purposes of the instant invention is directed toward recovering the shale oil as a primary product.

Recovery of oil from shale is theoretically simple in operation. Concisely described, the shale is broken and heated to about 900° F. under approximately ambient pressure. This operation drives the oil and gas products derived from kerogen contained in the oil shale, which products are recovered and refined in a manner similar to those liquid hydrocarbons currently being depleted. These oil products are raw shale oil, other organic hydrocarbons and some gases, hereinafter referred to as oil products.

Another similar method of removing oil from shale has been devised by the Lawrence Livermore Laboratory called the "Rise" method wherein a portion of the oil shale is removed by underground mining and the remainder is rubblized and retorted in place by a forward combustion technique. The rubble is created by a continuous mining process using a modified sublevel caving method which removes approximately 20% of the oil shale to the surface.

In addition to the forementioned art, other methods for in-situ retorting have been described. For example U.S. Pat. No. 3,917,344 teaches the use of sumps to collect the oil from individual retorts. U.S. Pat. Nos. 3,917,346 and 3,917,347 and 3,917,348 all teach different methods of permeating a subterranean zone using explosive means. Further information for such means can be found in U.S. Pat. Nos. 3,957,306 and 3,601,193.

However, all of these methods have several difficulties in common. For many deposits, oil shale is of insufficient depth to allow the large retorts of the prior art. Oil shale seams of smaller dimensions are more suitable to horizontal tunneling and fracturing. However, as pointed out in the prior art, these methods are largely inefficient and the retorts of large size are preferred. In addition, a portion of the kerogen tends to remain adhered to the oil shale and is difficult to recover.

It would therefore be of great benefit to provide a method for overcoming these disadvantages of the prior art providing good recovery of kerogen from oil shales.

It is therefore an object of the instant invention to provide an improved method for recovering kerogen from shale oil deposits. Other objects will become apparent to those skilled in this art as the description proceeds.

It has now been found that kerogen production from oil shale deposits by driving a substantially horizontal sloping tunnel under a portion of the deposit, explosively rubblizing the roof and walls of the tunnel, and fireflooding the rubblized zone to retort kerogen from the deposit can be greatly improved by shaping and lining the floor of the tunnel to form a covered sump sloping to the tunnel opening where produced oil or liquid hydrocarbons are recovered. It has further been found that the problems of incomplete combustion can be largely alleviated by explosively rubblizing the tunnel in sections, forming chambers having arches of non-rubblized shale separating said chambers. These arches are pierced by an opening of the same size as the original tunnel thus allowing one continuous retort from one end of the tunnel to the other while recovering kerogen continuously from the lined tunnel floor containing a sump.

This method is applicable for all conditions of retorting, such as various temperature, gases injected, vents from the surface to the rubblized zone, etc. as described in the referenced U.S. Patents. The instant invention is designed to improve the recovery from substantially horizontal tunnels underlying shale oil deposits, and is particularly suited to shale oil deposits which are of smaller thicknesses than some of the massive shale deposits which are often up to 3,000 feet thick.

In driving the tunnel under the shale oil deposit, it is necessary to have a vertical face exposed. This vertical face can be naturally exposed as is often found in the Western United States, or it can be exposed simply by first driving a substantially vertically bore. When shale deposits of greater thickness are being mined using the method of the instant invention, a tunnel can be driven, blasting completed, and retorting carried out with kerogen recovery. Subsequently, further tunnels can be driven on either side, top or bottom of the original tunnel, then lined, explosively rubblized and retorted as described, thus allowing maximum recovery of the kerogen contained in the shale oil.

The invention is more concretely described with reference to the drawings. Briefly described, FIG. 1 is a drawing in side view showing an oil shale deposit having two vertical faces exposed. A tunnel is driven completely under the deposit, the rubble removed therefrom being used to form service terraces on the outside of the tunnel. This drawing illustrates a specific application and it must be realized that the tunnel could be driven directly into a shale face without the necessity of having an opening at either end. However, the advantages of the opening at both ends, allowing a natural flue, are apparent.

FIGS. 4 and 5 are various views of a chambered tunnel showing the rock arches which will channel the flue gasses and increase retorting efficiency in a horizontal tunnel.

According to the present invention, a subterranean shale oil deposit is prepared for a recovery of kerogen by driving a tunnel of limited height under the deposit. The tunnel will normally not have pillars for support as the tunnel will be of relatively small diameter although such pillars can be used for larger tunnels. Using the method of the instant invention, tunnel size is not critical and larger tunnels are of course preferred, although the retort size will be determined by the size of the blast hole. The tunnel is normally designed to provide about 25% voids in the rubblized area although this amount can range from 15 to about 45%.

Figure 1:
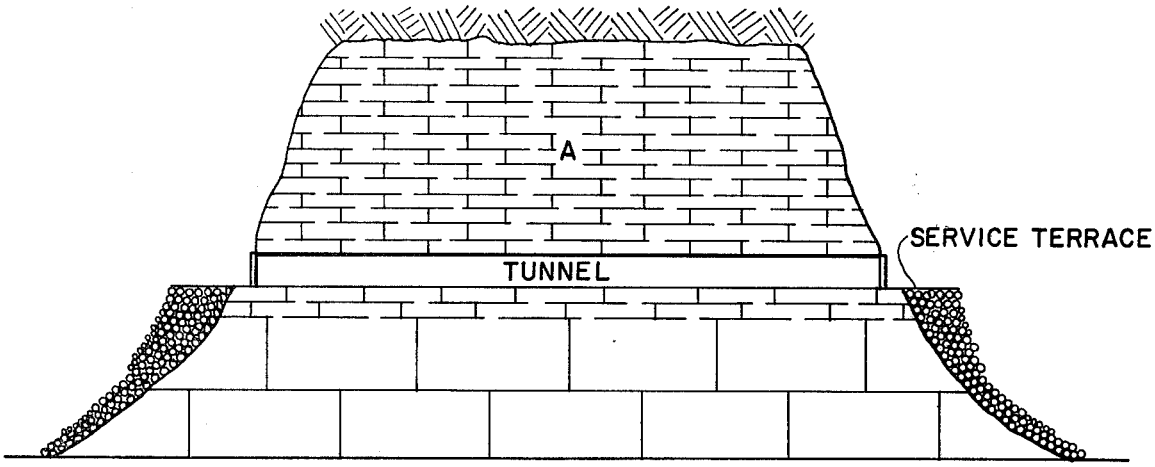

In FIG. 1 the tunnel is driven horizontally through a shale oil deposit represented by (a). Material removed is optionally used to form a service terrace either at one end, or if completely through a deposit, at both ends of the surface tunnel.

Figure 2:
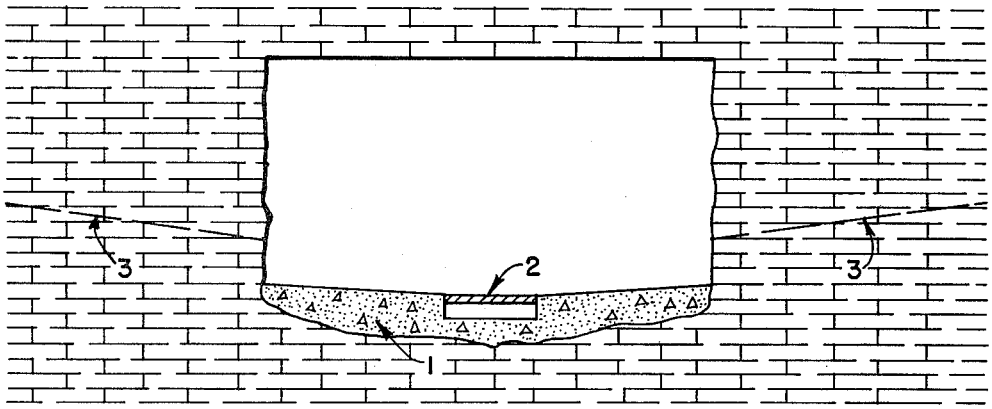
FIG. 2 is a cross-section showing a tunnel after having been formed together with the sump and the lined floor.

In FIG. 2 a cross-section of the tunnel is represented where (1) represents the tunnel lining. This lining will normally be of concrete which is slip formed to to provide a continuous sheet from the extreme end of the tunnel to the opening at which kerogen is recovered. This lining is formed with a sump therein and sloped along lines sufficient to allow pyrolysis products to drain into the sump. The sump is normally covered by a grating (2) which can be composed of iron or other suitable material. This floor lining greatly increases the amount of kerogen recovered since pockets, voids and cracks need not be filled before kerogen reaches the sump. The dotted lines (3) represent the approximate shot pattern which will be followed to allow the retorted kerogen to drain into the lining of the tunnel.

Figure 3:
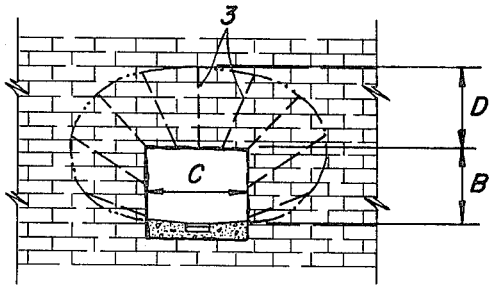
FIG. 3 shows a radial blast pattern from a cross-sectional view of the tunnel. Vertical drilling is used for conventional rubblizing and angle drilling is used to form the chambers in one preferred embodiment of the instant invention.

The amount of void area in the rubblized material is calculated based upon the cross-sectional diameter of the tunnel as shown in FIG. 3 wherein (B) represents tunnel height and (C) represents tunnel width. A radial shot pattern is drilled as represented by the dotted lines and the area of the radius so described is calculated to determining the depth of the shot pattern and thus to provide the void volume desired illustrated by the broken circle. In the figure, (D) represents the height of the shale area rubblized by the explosive.

Drilling for shot charges can be done easily in the lined tunnel. These methods are well-known in the mining art.

Figure 4:
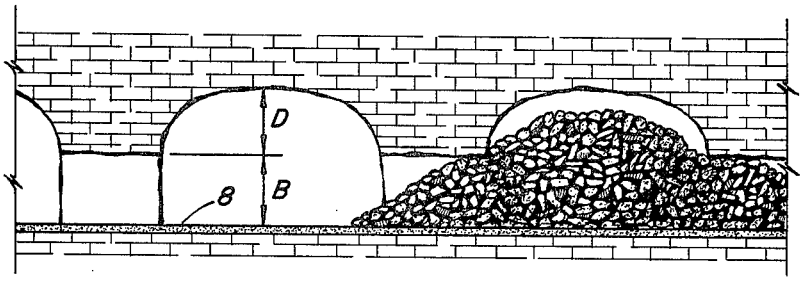
FIG. 4 is a view from the shale showing the floor lining together with empty and rubble filled chambers.

The length of the tunnel is continuously drilled at the determined depth to provide patterned cracking for closer control of rubble particle size. FIG. 4 describes a view from the oil shale which supports the tunnel lining (5) and sump (6). The dotted lines in FIG. 3 represent holes bored into the oil shale from near the floor of the tunnel which slope from the shale toward the lining in the tunnel. The spacing of these holes and the loading of explosive charge in every hole, alternate holes, etc. are determined by the fracture patterns desired. It will be apparent that the lining of the tunnel (8) will normally not be disturbed by a blast pattern of this type.

Figure 5:
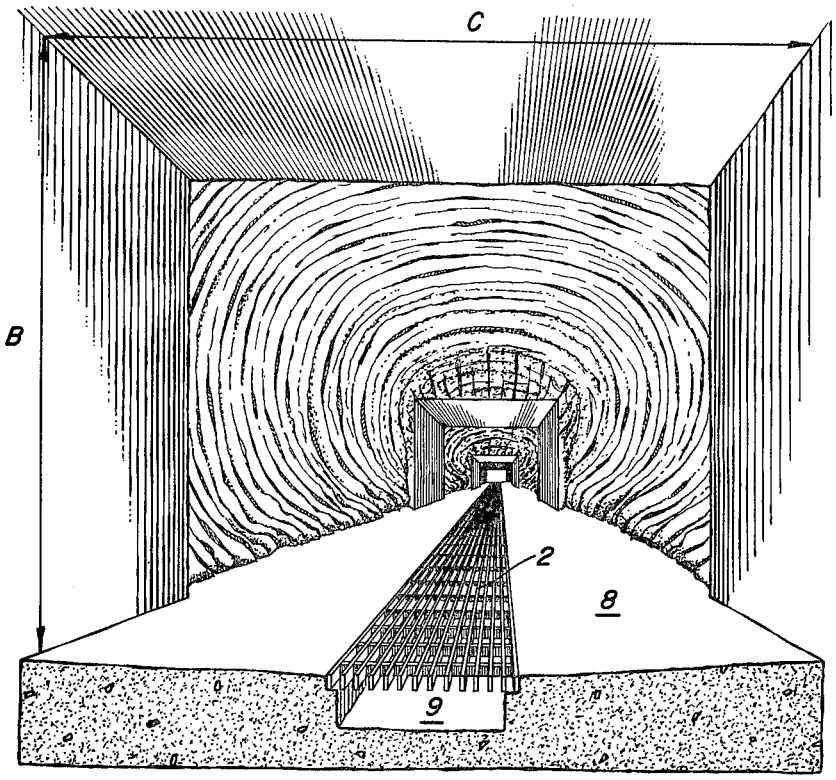

As previously described, it is preferred that the tunnel be chambered by intermittent blasting charges such that an arch of rock which narrows to the size of the original tunnel remains between the various retorts. As the fireflooding is begun at one end of the tunnel, these arches will force the hot gases produced, which normally travel upward and along the surface of the rubblized zone furthest away from the tunnel and sump, back down toward the bottom, thus providing more complete recovery. This facet of the instant invention clearly advances the prior art, in which it is well-known that horizontal tunneling has severe problems with respect to incomplete combustion. FIG. 4 is a cross-section view of the tunnel length showing retort chambers formed by intermittent explosive charges. Since oil shale is relatively impermeable compared to the rubblized zone, the flame front will penetrate the arches only to a small degree allowing the arches to continue to channel the flame front in a manner most favorable to maximum recovery throughout the process. FIG. 5 is a three-dimensional view showing the arches as they approach from the sides of the original tunnel. In both drawings, (8) represents the lining of the tunnel which is placed prior to explosively rubblizing the oil shale, and in FIG. 5 (9) represents the covered sump for withdrawal of the kerogen, said sump covered by a metal grate (2).

In practice, the instant invention is carried out as follows:

A tunnel is driven through the shale oil deposit. The floor of the tunnel is designed to slope toward the side of the deposit where the recovered oil will be produced, although the tunnel is substantially horizontal. The tunnel is placed near the bottom of the richest part of the formation. The waste rock from the tunneling operation can be used to build a service terrace as shown in FIG. 1 although this is entirely optional. The tunnel can be mined by either conventional methods or a mechanized boring machine. Once the tunnel has been prepared the floor is shaped into a covered sump to collect the kerogen produced during the retorting step. The floor of the tunnel is then lined with a lining material of high mechanical strength and which can be easily slip-formed such as concrete to prevent oil seepage into the native rock, all of which is illustrated by FIG. 2. The sump is then covered with an optional grate to prevent blockage of the sump throughout the length of the tunnel.

The rubble is produced by drilling shot holes into the roof and wall of the tunnel and blasting the roof and walls into the tunnel upon retreat. The volume of the tunnel in effect becomes the void volume of the rubble pile. It is therefore apparent that the extent of the shot holes will be determined by the target void volume. In one example, a tunnel 30 feet by 20 feet in a target void volume of 25% would dictate a rubble pile of roughly 80 feet across and 40 feet high as shown by the shot pattern in FIG. 3. This would require shot holes in the roof of walls be drilled between 21 and 26 feet from the surface of the tunnel.

The shot holes in the roof and walls can be drilled either vertically or at an angle with respect to the tunnel axis. The spacing and loading of these holes to optimize breakage of the oil shale would be determined emperically based upon the individual formation. Many of the drilled holes will be used to control breakage and will not contain explosives during the blast. Formation of a slanting blast may require that the walls be detonated a few milliseconds before the roof.

The pressure drop across the gallery of broken rock is important to the retorting process. If possible, the most desirable approach is to seal the tunnel at both ends and fireflood the rubble pile from one end to the other. In the event of excessive pressure drops, it may be necessary to drill intermediate holes from the top of the mountain to the tunnel for flow control of the oil and gases. These methods are well described in the prior art.

If the tunnel is open at both ends a mixture of air and water or air and combustion gas will normally flow from one end of the tunnel to the other. However, if the tunnel is sealed at both ends as described in one embodiment of the instant invention, a mixture of air and water or air and combustion gas will be injected at one end to support the combustion process which provides the retorting. An alternate method will be to control the oxygen content of the combustion air with steam or water vapor while allowing the retorted air to drain to the sump of the tunnel and exit by the low end.

One embodiment of the instant invention also overcomes the prior art objections to horizontal tunneling where an incomplete combustion is noticed because the flame front tends to travel across the top of the rubble pile rather than permeate the rubble evenly. By the method of the instant invention it is possible to redistribute the fireflood by leaving a segment of the roof and walls at intervals along the tunnel as shown in FIG. 5. This chambering of the tunnel is much faster, more economical, and simple to operate than prior art methods of retorting.

Tunneling and rubblizing operations described herein can be highly automated thus reducing costs to a minimum. The sump in the floor of the tunnel can be prepared by slip forms in the manner that concrete paving is laid for roads, sidewalks and other uses. After a tunnel has been expended, further mining operations can be carried out or if the oil shale be exhausted, the portals can be closed and the face of the deposit restored at minimum cost.

As an example of recovery when using the process of the instant invention, one rubble pile 80 feet by 40 feet and 3,000 feet long having a 25% void volume would contain about 400,000 tons of broken shale. If the shale would yield 25 gallons per ton average quantity shale oil 15–40% and a 20% recovery, a single rubble tunnel would yield about 48 thousand barrels of raw shale oil.

While certain embodiments and details have been shown for the purpose of illustrating this invention, it will be apparent to those skilled in this art that various changes and modifications may be made herein without departing from the spirit or the scope of the invention.

I claim:

1. An improved method for recovering oil products from shale oil deposits having an exposed substantially vertical surface by driving a substantially horizontal tunnel under a portion of the deposit, sloping the tunnel to a tunnel opening in the substantial vertical face, said tunnel containing a sump, explosively rubblizing the roof and walls of the tunnel and fireflooding the rubblized zone to retort oil products from the deposit, the improvement comprising explosively rubblizing the tunnel in sections to form retort chambers having an arch of non-rubblized shale between chambers so as to force retort gases toward the bottom of the rubblized zone to increase combustion and enhance recovery of oil shale combustion products.

* * * * *